US010414419B2

(12) United States Patent
Brandt et al.

(10) Patent No.: US 10,414,419 B2
(45) Date of Patent: Sep. 17, 2019

(54) MULTIPLE DIRECTION RAILROAD GATE RELEASE MECHANISM

(71) Applicant: MTR Technologies, Inc., Brookings, SD (US)

(72) Inventors: David Leon Brandt, Brookings, SD (US); Arlyn Douglas Wadsworth, Brookings, SD (US); Roger Wade Debates, Brookings, SD (US)

(73) Assignee: MTR Technologies, Inc., Brookings, SD (US)

( * ) Notice: Subject to any disclaimer, the term of this patent is extended or adjusted under 35 U.S.C. 154(b) by 152 days.

(21) Appl. No.: 15/499,865

(22) Filed: Apr. 27, 2017

(65) Prior Publication Data

US 2017/0313333 A1 Nov. 2, 2017

Related U.S. Application Data

(60) Provisional application No. 62/328,333, filed on Apr. 27, 2016.

(51) Int. Cl.
*B61L 29/04* (2006.01)
*E01F 13/06* (2006.01)
*E01F 13/08* (2006.01)

(52) U.S. Cl.
CPC ..... *B61L 29/04* (2013.01); *E01F 13/06* (2013.01); *E01F 13/08* (2013.01)

(58) Field of Classification Search
CPC ..... B61L 29/04; E01F 13/06; E01F 13/08
USPC ..... 49/9, 404, 49; 246/111
See application file for complete search history.

(56) References Cited

U.S. PATENT DOCUMENTS 1,628,651 A * 5/1927 Burress ..... B61L 29/02 256/13.1
1,665,157 A * 4/1928 Dahnke ..... G08G 1/09 49/192
4,227,344 A * 10/1980 Poppke ..... E01F 13/06 49/147
4,364,200 A * 12/1982 Cobb ..... E01F 13/06 49/141
4,864,772 A * 9/1989 Ecklund ..... A01K 3/00 49/59

(Continued)

FOREIGN PATENT DOCUMENTS

FR 2882071 A1 * 8/2006 ..... E01F 13/06

*Primary Examiner* — Marcus Menezes
(74) *Attorney, Agent, or Firm* — Schwegman Lundberg & Woessner, P.A.

(57) ABSTRACT

A multiple direction railroad gate release mechanism which is attached between the mount arms of a railroad gate actuator and a crossing arm to prevent breakage of the crossing arm due to impingement in either a frontal or rearward direction by a vehicle or other outside force. A pivot arm assembly allows a released movement of the crossing arm in reaction to frontal impingement and returns the crossing arm to the original and detent position subsequent to an impingement in order to maintain grade crossing protection. A spring return assembly, a shock absorber, and a detent plunger act to return the pivot arm assembly and attached crossing arm to a neutral detent position. The pivot arm assembly allows for rotation about a single pivot point of at least ±/−90 degrees relative to the longitudinal axis of the attached crossing arm.

13 Claims, 14 Drawing Sheets

(56) References Cited

U.S. PATENT DOCUMENTS

| | | | | | |
|---|---|---|---|---|---|
| 4,897,960 | A * | 2/1990 | Barvinek | B61L 29/02 | 49/192 |
| 5,469,660 | A * | 11/1995 | Tamenne | B61L 29/08 | 49/192 |
| 6,370,821 | B1 * | 4/2002 | McCord | E01F 13/06 | 49/34 |
| 6,470,626 | B2 * | 10/2002 | Luetzow | E01F 13/06 | 404/10 |
| 6,672,008 | B1 * | 1/2004 | Luetzow | E01F 13/06 | 404/10 |
| 6,966,146 | B2 * | 11/2005 | Pease | B61L 29/10 | 49/49 |
| 8,001,724 | B2 * | 8/2011 | Ponert | G07C 9/02 | 49/34 |
| 8,161,681 | B2 * | 4/2012 | Treihaft | E05F 15/63 | 49/141 |
| 8,240,618 | B1 * | 8/2012 | Luetzow | B61L 29/04 | 246/111 |
| 8,601,739 | B2 * | 12/2013 | Deitchman | E01F 13/06 | 49/49 |

* cited by examiner

MULTIPLE DIRECTION RAILROAD GATE RELEASE MECHANISM

CLAIM OF PRIORITY

This non-provisional patent application claims the benefit of priority under 35 U.S.C. § 119(e) to U.S. Provisional Patent Application Ser. No. 62/328,333, entitled "MULTIPLE DIRECTION RAILROAD GATE RELEASE MECHANISM," filed on Apr. 27, 2016, which is hereby incorporated by reference in its entirety.

BACKGROUND

Railroad crossing grades are protected by railroad grade crossing arms which are stored substantially in a vertical position and which are actuated by railroad gate actuators. The actuators reorient the crossing arms to a horizontal position across a railroad crossing grade. The crossing arms warn operators of vehicles of oncoming train traffic and physically place a barrier in the form of a crossing arm at both sides of the railroad crossing grade to discourage and prevent the passage of a vehicle into the railroad crossing grade Motorists unaware of the movement of a crossing arm may impinge either the front or the back of the crossing arm to the extent that physical damage may occur whereby the crossing arm is broken or parted from the railroad gate actuator. In some situations, the motorist may physically damage a first crossing arm or may avoidingly maneuver the motor vehicle around the end of the first crossing arm whereby damaging impact with a second opposed crossing can result. Such an occurrence can compromise the safety of the railroad grade crossing in that other motorists will not be warned of impending danger due to the destruction of one or more of the crossing arms. Such occurrences will compromise safety as well as add a financial maintenance burden.

Overview

The present disclosure provides a railroad gate release mechanism, and in particular, a multiple direction railroad gate release mechanism which allows for maintaining the structural integrity of a railroad grade crossing arm when struck from one or more directions by an automotive vehicle. Although a multiple direction railroad gate release mechanism is described, the release mechanism can be used for other gates such as, but not limited to, parking lot gates, restricted access gates, road closure gates, toll gates, crowd control gates and the like.

The present inventors have recognized, among other things, that a problem to be solved can include reducing the physical damage to crossing arms from motorists. Depending on where a motorist may contact a crossing arm the amount the crossing arm needs to pivot before structural damage occurs can vary. The present inventors have solved the problem by providing a railroad gate release mechanism that can rotate +/−90 degrees relative a neutral position. Thus, regardless of the impact point, the railroad gate release mechanism of the present disclosure reduces the risk of physical damage by allowing for 90 degrees of rotation and thereby clearing the crossing arm from the moving motorist from the passageway.

Additionally, the present inventors have recognized that the force required to move the crossing arm from the neutral position may not be the same in every situation where the railroad gate release mechanism is used. The present inventors have solved this problem by providing a railroad gate release mechanism with an adjustable force. That is, a user can manually adjust the force needed to move the crossing arm from the neutral position. For example, in areas of high wind or during storms, the force required to move the crossing arm can be increased such that the crossing arm will not move from the neutral position due to non-motorist reasons such as high winds.

There may be times when the railroad gate release mechanism is not needed and gate release mechanism of the present disclosure provides for a locked position. The present inventors have provided two locking features. The first includes locking the crossing arm in a locked position including a locking bolt that will not allow the crossing arm to move from the neutral position within causing physical damage to the crossing arm. The second includes locking the crossing arm in a fixed position with a shear bolt such that, before structural damage occurs, the shear bolt will break when a predetermined force is applied. Thus, if a force is applied such that the shear bolt breaks, the only replacement part would be the shear bolt versus an entire crossing arm and/or other components of the gate release mechanism.

In additional embodiments, the gate release mechanism can include a counter such that after installation of the gate release mechanism, a user can look to see how many times the gate release mechanism has been utilized providing valuable information to a user.

This overview is intended to provide an overview of subject matter of this document. The overview discusses the inventive subject matter in a general, non-limiting, manner to provide an introduction to the more detailed description provided below in reference to the various figures included in this disclosure. It is not intended to provide an exclusive or exhaustive explanation of the invention. The detailed description is included to provide further information about the present document.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure is for a railroad gate release mechanism, and in particular, for a multiple direction railroad gate release mechanism which allows for maintaining the structural integrity of a railroad grade crossing arm when struck from one or more directions by, for example, an automotive vehicle. Although a multiple direction railroad gate release mechanism is described, the release mechanism can be used for other gates such as, but not limited to, parking lot gates, restricted access gates, road closure gates, toll gates, crowd control gates and the like.

Figure 1:
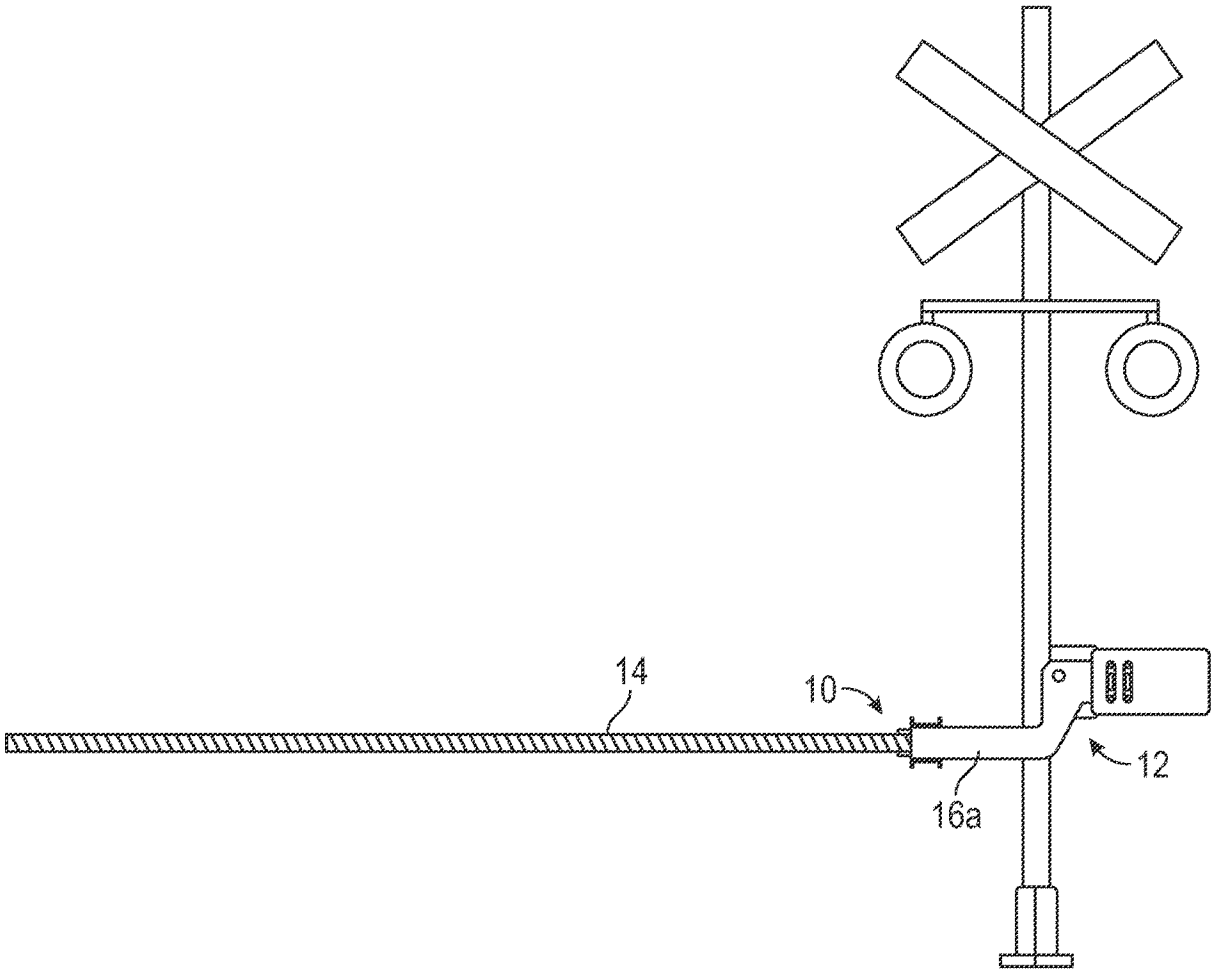
FIG. 1 illustrates a gate release mechanism, according to some example embodiments.

FIG. 1 shows the use of the multiple direction railroad gate release mechanism 10 (also referred to herein as "gate release mechanism") of the present disclosure. A railroad gate actuator 12 is shown in the actuated position to position the multiple direction railroad gate release mechanism 10 and attached crossing arm 14 in a horizontal position. The multiple direction railroad gate release mechanism 10 is mounted between the ends of the mount arms 16*a* and 16*b* (FIG. 2) and the crossing arm 14 is mounted to the multiple direction railroad gate release mechanism 10.

As discussed herein, the present disclosure provides a multiply direction railroad gate release mechanism that can rotate 90 degrees in either direction with an automatic return to a neutral position, and provides for adjustment of the force required to break away from the center or neutral position. The gate release mechanism 10 allows the crossing arm 14 to rotate 90 degrees in either direction while rotating about a single pivot point as well as an adjustable detent force that changes the force necessary to move the gate arm (also referred to herein as "crossing arm") from the neutral position.

Figure 2:
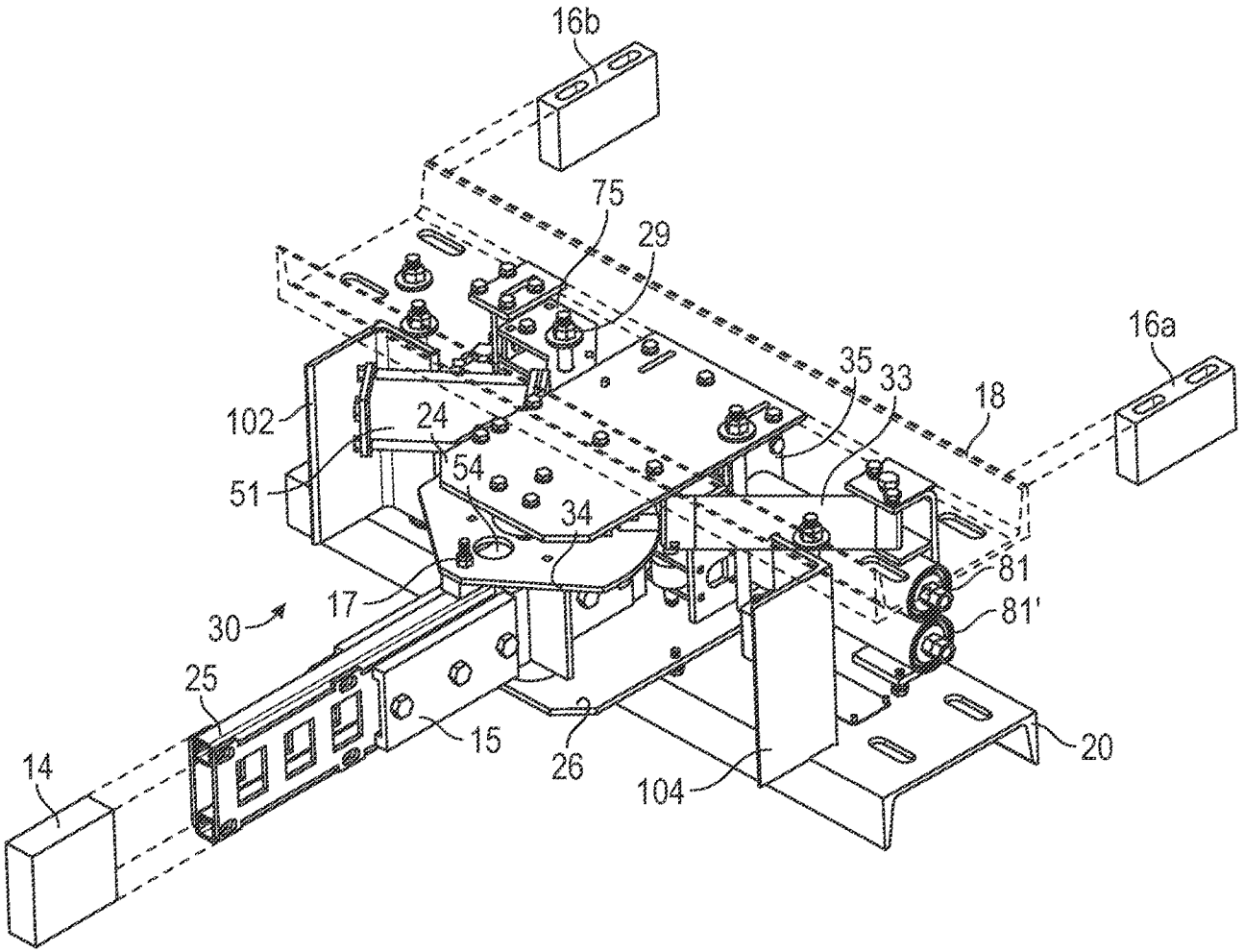
FIG. 2 is a perspective view of a portion of the gate release mechanism, according to some example embodiments, along with portions of mount arms and a crossing arm which are associated therewith in use.

FIG. 2 is perspective view of the railroad gate release mechanism 10 of the present disclosure showing its connecting relationship between mount arms 16*a* and 16*b* of the railroad gate actuator 12 and the crossing arm 14. Top and bottom mounting brackets 18 and 20 in the form of channels accommodate attachment of the mount arms 16*a* and 16*b*. The crossing arm 14 is coupled to a pivot arm assembly 30 of the multiple direction railroad gate release mechanism 10. As shown in FIG. 2, the crossing arm 14 is shown in a horizontal position, such as for stopping traffic at a railroad grade crossing. The crossing arm 14 is at a neutral position in FIG. 2 and the longitudinal axis of the crossing arm 14 is perpendicular to the longitudinal axis of the mounting brackets 18 and 20.

Figure 3:
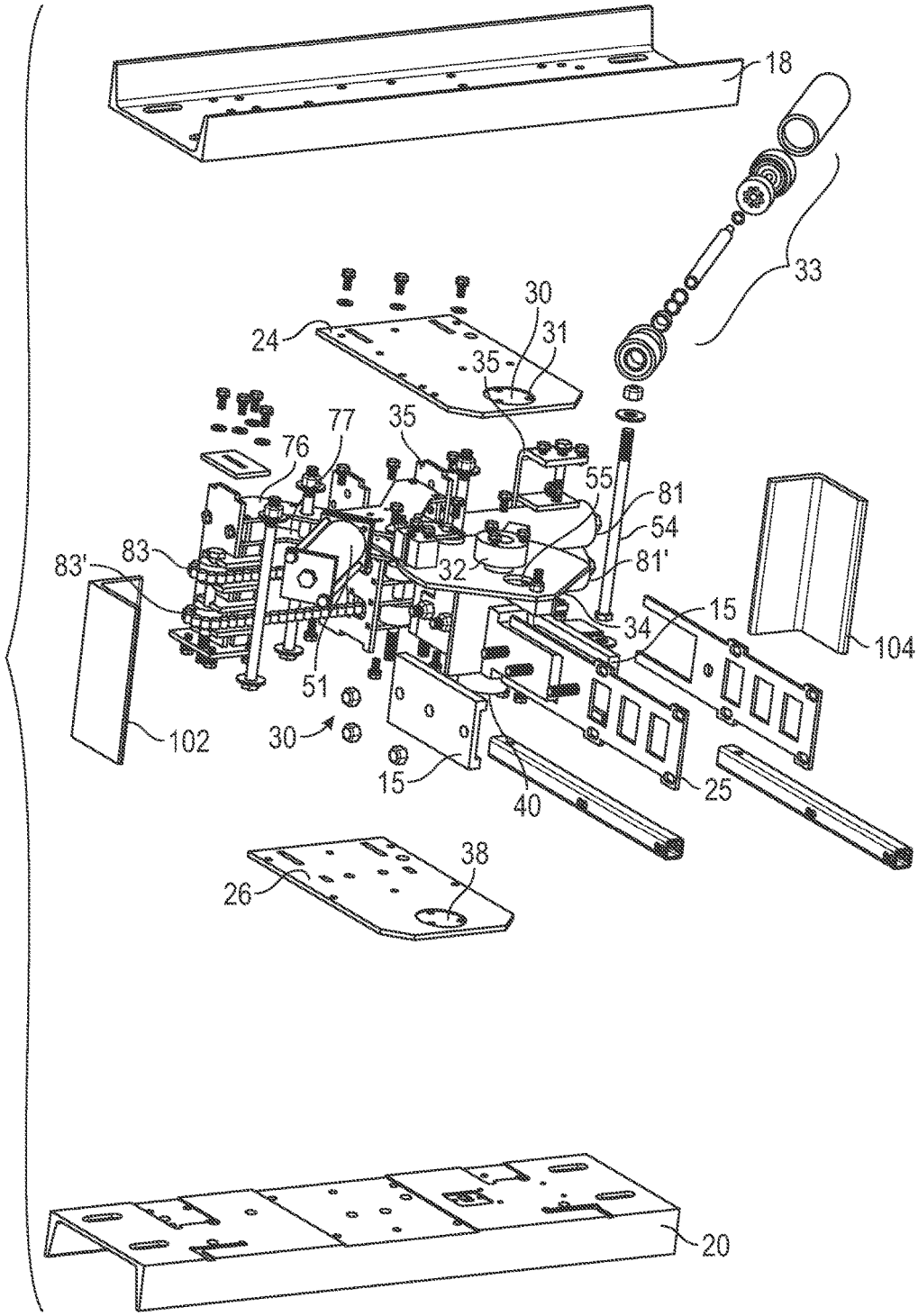
FIG. 3 is an exploded perspective view of the components of the gate release mechanism, according to some example embodiments.
Figure 4:
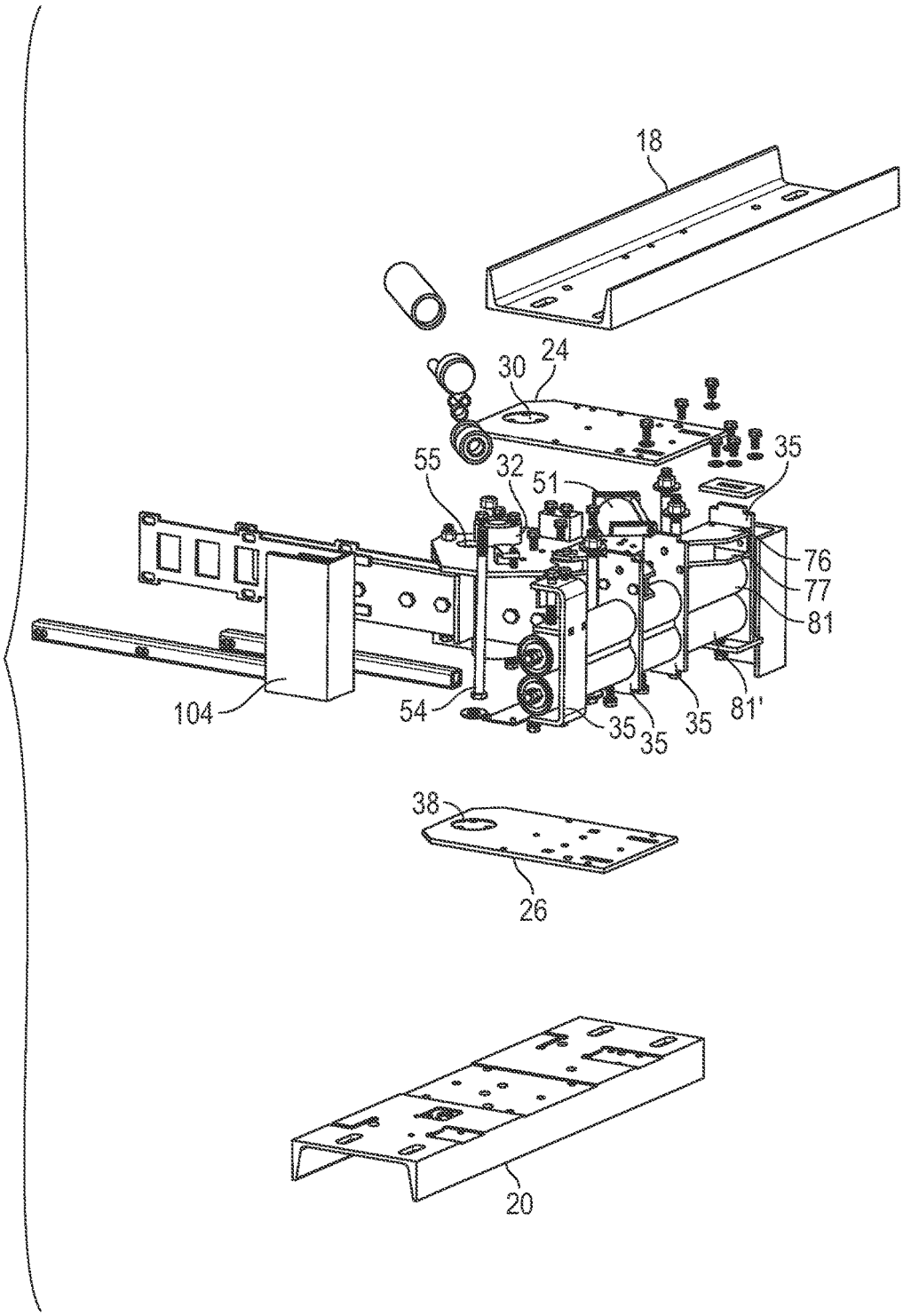
FIG. 4 is another view of the exploded perspective view of the components of the gate release mechanism, according to some example embodiments.

Multiple views of the gate release mechanism 10 are included for a full understanding of the present invention. FIGS. 3 and 4 are exploded views of the components of the gate release mechanism 10. In the disclosure, a plurality of nuts, bolts, and lock washers are secured through a plurality of holes in a plurality of diverse components as is common practice in the art and as are shown or indicated in engagement or alignment wherever practicable or suitable in the accompanying illustrated figures.

Partial or fully visible components of the gate release mechanism 10 include opposing top and bottom mounting brackets 18 and 20 in the form of a channel, each having a plurality of mounting holes 22*a*-22*n* used in the attachment of mount arms 16*a* and 16*b* of the railroad gate actuator 12, as well as other holes and features for mounting other components thereto. Opposed top and bottom bearing support plates 24 and 26 are preferably aligned with recessed surfaces on the inwardly facing surfaces of the top and bottom mounting brackets 18 and 20 are suitably secured thereto. The support plate 24 includes a circular recess 30 opening downwardly for the fixed accommodation of a top bearing assembly 32. The top support plate 24 can include holes 31 to receive pins to couple to the bearing assembly 32. Also, the bottom bearing support plate 26 includes a circular recess 38 opening upwardly for the fixed accommodation of a bottom bearing assembly 40. The bottom bearing support plate 26 can include holes 41 for to receive pins to couple the support plate 26 to the bearing assembly.

The pivot arm assembly 30 is aligned between the top and bottom bearing support plates 24 and 26, respectively, and is mounted and pivotally secured therebetween by the pivot pin 54 which is in close intimate contact with the top bearing assembly 32 and the bottom bearing assembly 40. The pivot pin 54 is the single pivot point 55 that the crossing arm 14 rotates about. The pivot arm assembly 30 includes, in part, a swing arm 25 configured to be coupled to the crossing arm 14 and a detent cam 34.

Figure 7:
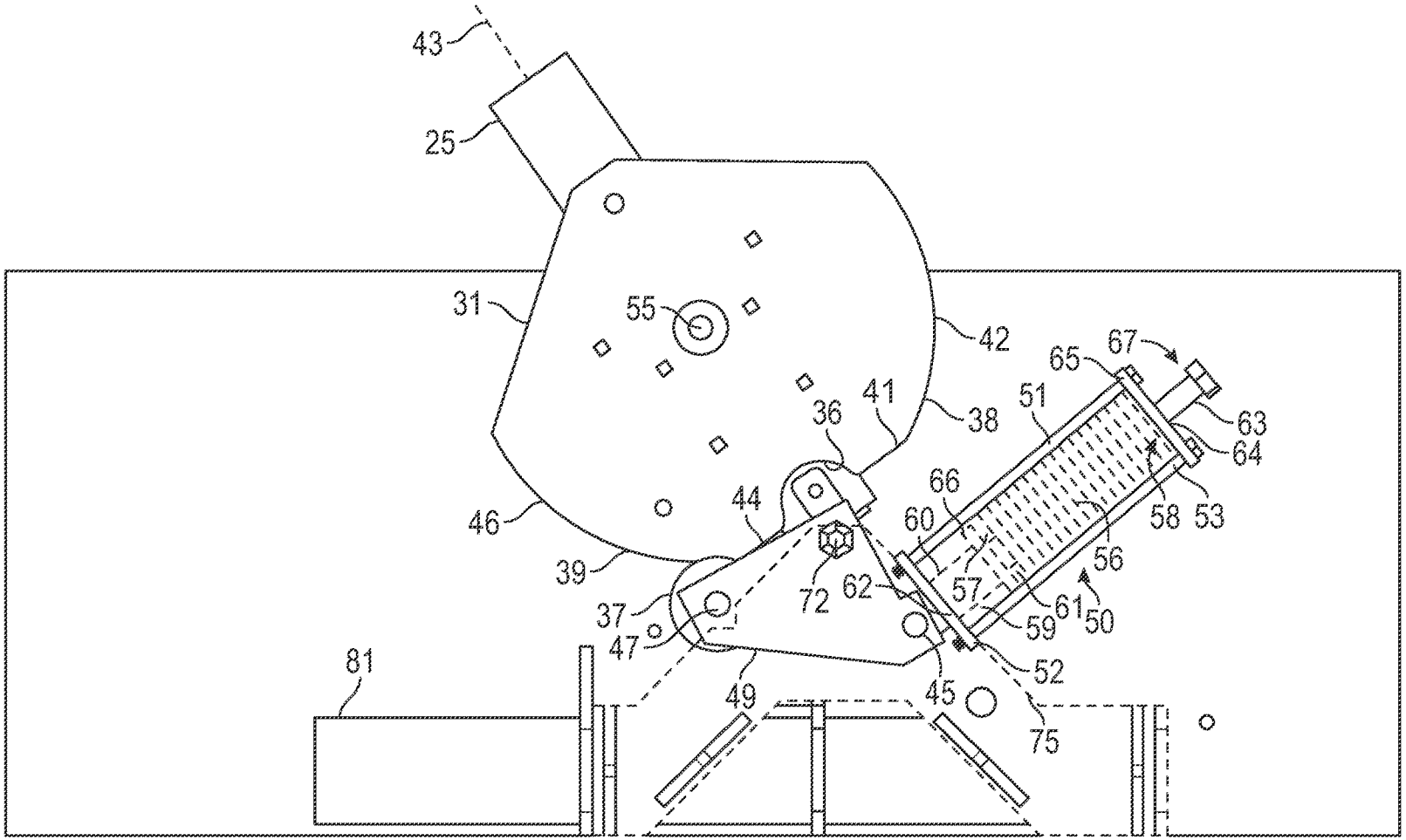
FIG. 7 a top view of the portion of the gate release mechanism shown in FIG. 6 in a non-neutral position.

As shown in FIG. 7, the detent cam 34 includes a first guide surface 38, a second guide surface 39, and a semicircular detent 36. The semicircular detent 36 is positioned between the first guide surface 38 and the second guide surface 39. The first and second guide surfaces 38, 39 each include a flat portion 41, 44 and a curved portion 42, 46. In an example embodiment, the curved portions 42, 46 have a constant radius of curvature. The swing arm 25 is coupled to the detent cam 34 such that the swing arm 25, the pivot point 55 and the semicircular detent 36 are aligned with each other along a longitudinal axis 43 of the swing arm 25.

Figure 5:
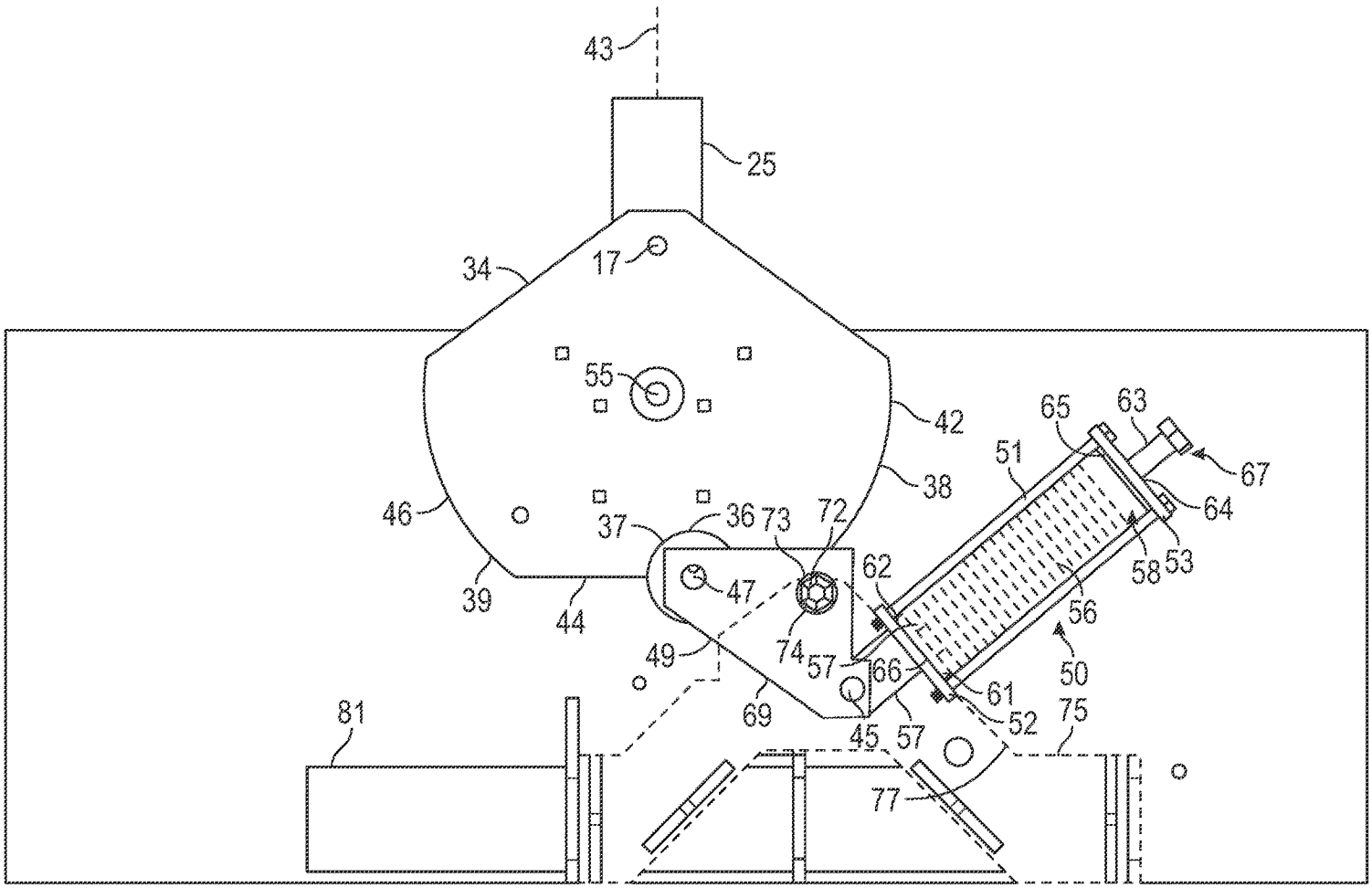
FIG. 5 a top view of a portion of the gate release mechanism assembly, according to some example embodiments.
Figure 6:
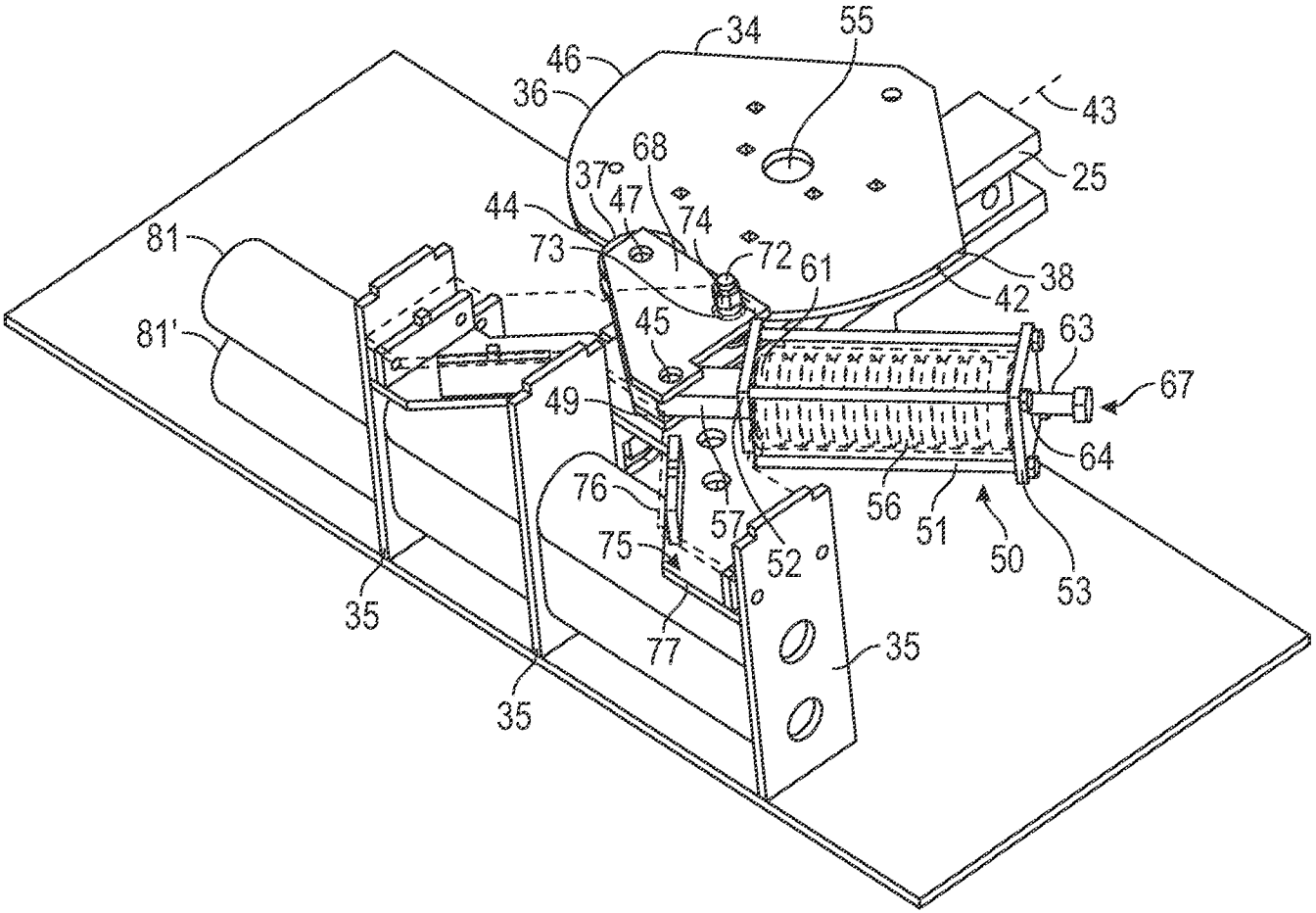
FIG. 6 is a perspective view of the portion of the gate release mechanism shown in FIG. 6.
Figure 8:
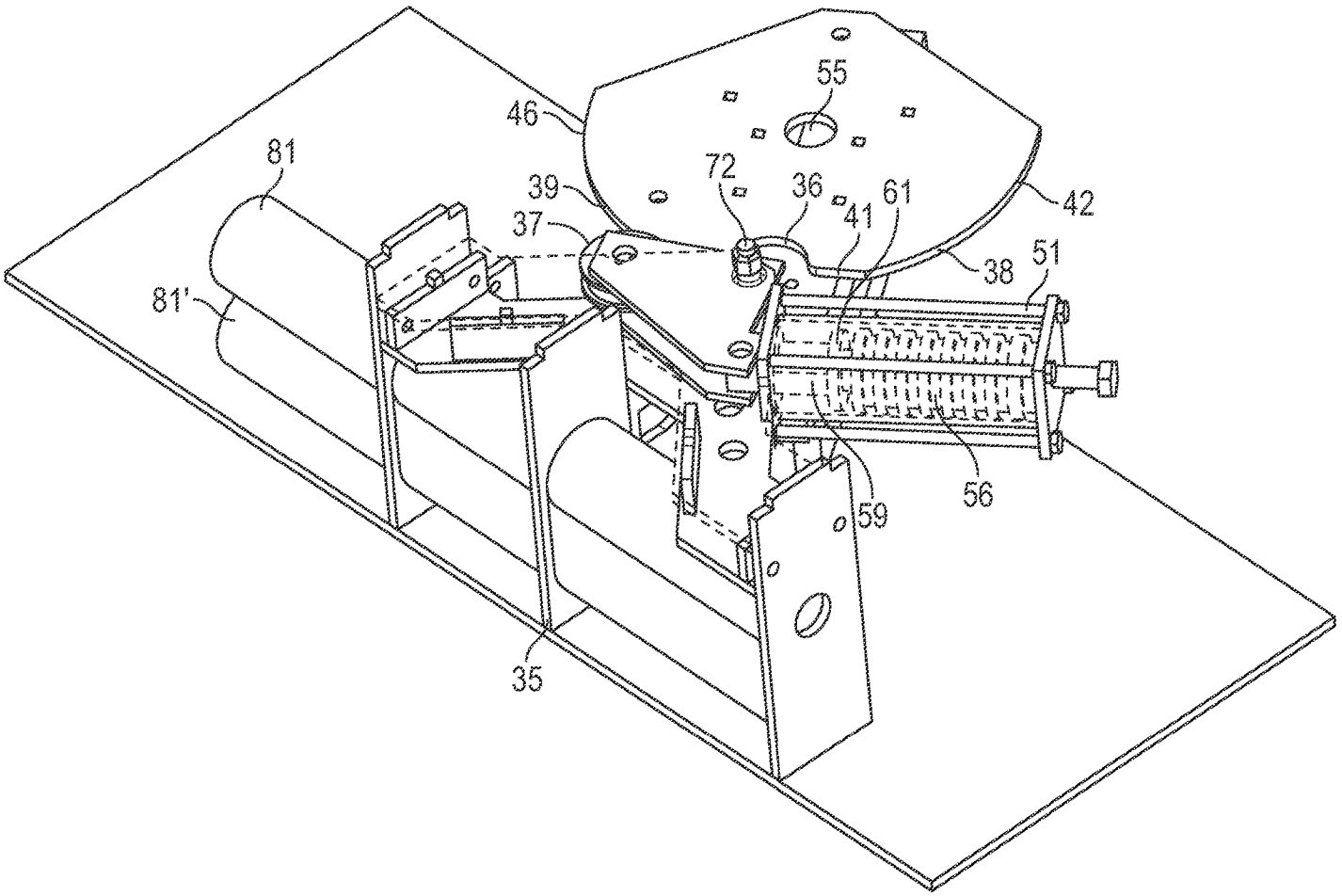
FIG. 8 is a perspective view of the portion of the gate release mechanism shown in FIG. 8.
Figure 9:
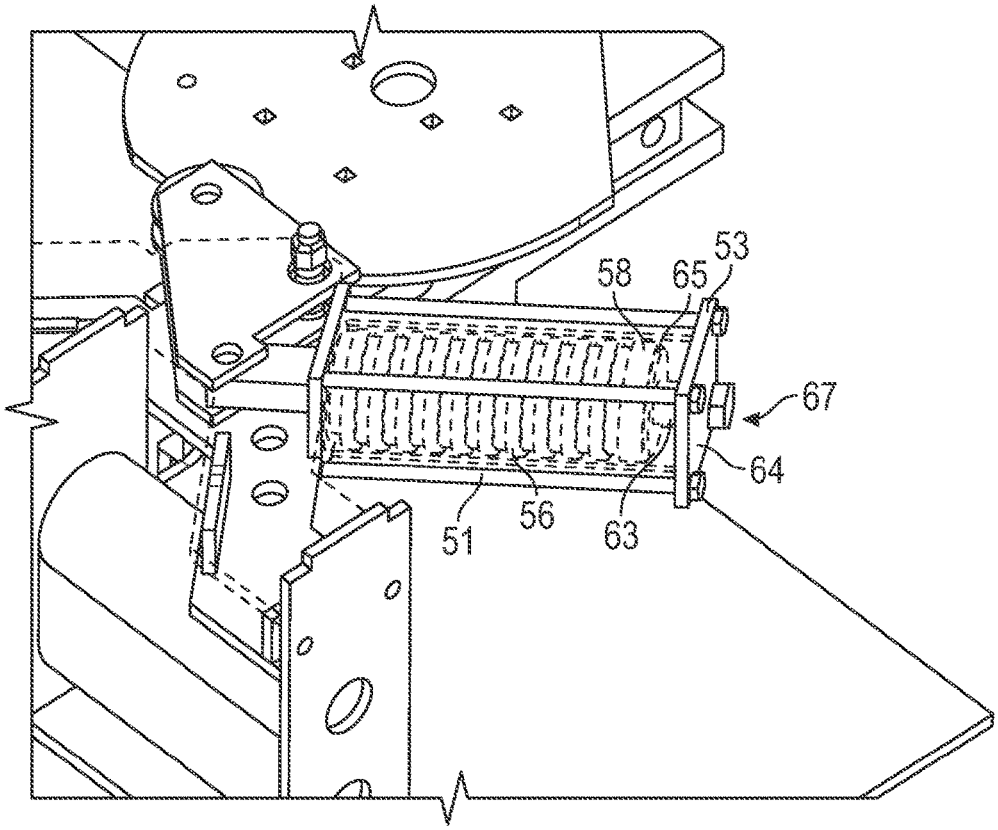
FIG. 9 is a perspective view of a portion of the gate release mechanism showing adjustment of the spring force of a decent plunger, according to some example embodiments.

The semicircular detent 36 is formed by a semicircular cutout in the detent cam 34 and configured to receive the detent roller 37 when the swing arm 25 is at a neutral position (shown in FIGS. 5-6). The detent roller 37 is configured to move along the first guide surface 38 when a force acting on the swing arm 25 is in a first direction and the detent roller 37 is configured to move along the second guide surface 39 when a force acting on the swing arm 25 is in a second direction, opposite the first direction. In FIGS. 8 and 9, a force was applied to the swing arm 25 in the second direction moving the detent roller 37 from the neutral position within the semicircular detent 36 and along the second guide surface 39.

The pivot arm assembly 30 also includes a detent lever 49 and a detent plunger 50. The detent plunger 50 is coupled to the detent lever 49 and configured to apply a force to the detent roller 37 to force the detent roller 37 into the semicircular detent 36. In a neutral position, the detent roller 37 is positioned within the semicircular detent 36 via the detent plunger 50 which forces the detent roller 37 into the semicircular detent 36. As discussed herein, the detent roller 37 can be forced from the semicircular detent 36 when a force acting on the swing arm 25 (e.g., a force acting on a crossing arm attached to the swing arm 25) is greater than the force of a resilient member 56 and pushes the plunger shaft 59 into the plunger housing 51. As discussed herein, the force of the resilient member 56 can be adjusted via the detent plunger 50.

The detent plunger 50 includes a plunger housing 51, the resilient member 56 positioned within the plunger housing 51, and the plunger shaft 59. The plunger housing 51 includes a first end plate 52 and a second end plate 53. The plunger housing 51 can also include a tubular housing 67 (shown in FIG. 4) extending between the first and second end plates 52, 53. The resilient member 56 is positioned within the plunger housing 51 and has a first end 57 and a second end 58. The resilient member 56, e.g., a spring, can be in a compressed state. That is, the length of the plunger housing 51 between the first and second end plates 52, 53 is such that the resilient member 56 is in a compressed state. The plunger shaft 59 has a first end 60 and a second end 61. The plunger shaft 59 is moveable relative to the plunger housing 51 and the first end 60 of the plunger shaft 59 is coupled to the detent lever 49. The second end of the plunger shaft 61 defines a shoulder 66 that is positioned inside of the plunger housing 51 and is configured to abut an inside surface 62 of the first end plate 52 and the first end 57 of the resilient member 56.

As discussed herein, the force of the resilient member 56, which is the force required to move the detent roller 37 from the semicircular detent 36 (i.e., move the swing 25 from the neutral position to a non-neutral position) is adjustable. The detent plunger 50 can include an adjuster 67 that includes an adjustment bolt 63 extending through and threadeably engaged with an aperture 64 of the second end plate 53 and an adjustment washer 65 coupled to the adjustment bolt 63 and positioned within the plunger housing 51 and configured to abut the second end 58 of the resilient member 56. The detent roller 37 can be forced from the semicircular detent 36 when the force acting on the swing arm 25 (via a crossing arm 14) is greater than the force of the resilient member 56.

By moving the adjustment bolt 63 at the end of the plunger housing 51, the force applied to the detent roller 37 can be adjusted and thereby increase or decrease the force required to move the detent roller 37 out of the semicircular detent 36. For example, if the adjustment bolt 63 is tightened and the distance between the first end plate 52 and the washer 65 is reduced, the plunger force acting on the detent roller 37 is increased. As the adjustment bolt 63 is loosened and the distance between the first end plate 52 and the washer 65 increases, the plunger force acting on the detent roller 37 is reduced. As discussed herein, even when the washer 65 is abutting the second end plate 53, the resilient member 56 is in a compressed state and provides a minimum force to the detent roller 37.

By having an adjustable force, the gate release mechanism 10 can be used in various situations without having to replace pieces of equipment. For example, the same gate release mechanism 10 can be used in a high wind areas and low wind areas. The only change needed would be to adjust the force via the adjustment bolt 63. Further, in various situations, the force required for the detent roller 37 to be pushed out of the semicircular detent 36 may need to change for an assembly at a particular site. For example, a single force may not be appropriate for all times of the year at a site. The adjustable force (e.g., adjustable resilient member force or plunger force) therefore allows a user to continually adjust the plunger force as necessary, without having to replace the entire mechanism.

The detent lever 49 can include a top detent lever plate 68 and a bottom detent lever plate 69. The detent roller 37 and the plunger shaft 59 are coupled to and positioned between the top and bottom detent lever plates 68, 69. Further, the detent roller 37 includes a top flange 70 and a bottom flange 71 that assists maintaining alignment of the detent roller 37 and the detent cam 34. For example, the top flange 70 can be positioned on a top surface of the detent cam 34 and the bottom flange 71 can be positioned on a bottom surface of the detent cam 34. The detent lever 49 can include a detent lever pivot point 72 about which the detent lever 49 rotates about. The detent lever 49 (including the top and bottom detent lever plates 68, 69) can include an aperture 73 configured to receive a pin 74 that couples the detent lever 49 to the detent lever frame 75. The detent lever frame 75 can include a top lever frame plate 76 and a bottom lever frame plate 77. For example, a top lever frame plate 76 can be positioned on top of the top detent lever plate 68 and the bottom lever frame plate 77 can be positioned on a bottom of the bottom detent lever plate 69. The pin 74 can extend through the top lever frame plate 76, the top detent lever plate 68, the bottom detent lever plate 69, and the bottom lever frame plate 77. The detent lever frame 75 can be coupled to the mounting brackets 18, 20. For example, the detent lever frame 75 can be coupled to a support frame 35 that is coupled directly to the mounting brackets 18 and 20, as discussed herein.

As shown in FIGS. 5 and 6, the swing arm 25 is at a neutral position and the detent roller 37 is positioned within the semicircular detent 36. The plunger shaft 59 is at the neutral position such that the shoulder 66 of the plunger shaft 69 is abutting the inside surface 62 of the first end plate 52 of the plunger housing 51. That is, the resilient member 56 is applying the plunger force to the detent roller 37 and the detent roller 37 is positioned within the semicircular detent 36.

Referring to FIG. 9, the adjuster 67 including the adjustment bolt 63 and washer 65 have been tightened to a maximum setting where the adjustment bolt 63 is advanced as far as it can and is abutting the second end plate 53 of the plunger housing 51. As shown in FIG. 9, the length of the resilient member 56 in the plunger housing 51, at the neutral position, has decreased thereby further compressing the resilient member 56 and increasing the plunger force being applied to the detent roller 37.

If enough force impacts the swing arm 25 (e.g., via the crossing arm or gate) to force the detent roller 37 out of the semicircular detent 36 in the detent cam 34, then the detent roller 37 is pushed out of the semicircular detent 36 and glides along either the first or second guide surfaces 38, 39 of the detent cam 34. As the detent roller 37 moves along either the first or second guide surfaces 38, 39, the resilient member 56 is compressed, as shown in FIGS. 7 and 8. For example, as the detent roller 37 is forced out of the semicircular detent 36, the detent lever 49 rotates about the detent lever pivot point 72 forcing the plunger shaft 59 to move relative the first end plate 52 and compress the resilient member 56 within the plunger housing 51. Additionally, the detent cam 34, the swing arm 25, and attached crossing arm 14 (as shown in FIG. 2) can rotate about the pivot point 55 up to at least +/−90 degrees. As shown in FIGS. 2 and 3, swing stops 102 and 104 are mounted to the device such that the swing arm 25 does not rotate past 90 degrees.

A locking aperture can be formed through the detent lever and the detent frame such that when a locking bolt 29 is placed through the locking aperture the swing arm 25 is not moveable without causing physical damage to the device. For example, this may be beneficial during a hurricane or storm. In additional embodiment, the locking bolt can be replaced with a shear bolt such that the swing arm 25 is not moveable but if enough pressure is applied the shear bolt will break prior to breaking other components of the device.

Once the force acting on the swing arm 25 stops, a spring return assembly 80 is configured to return the swing arm 25 from rotation (at a non-neutral position) about the pivot point 55 and back to the neutral position. The spring return assembly 80 can include a first spring return housing 81 and a second spring return housing 81'. The first and second spring return housing 81, 81' can be secured in a support bracket 35 that can be coupled to the mounting brackets 18, 20. The first spring return housing 81 and the second spring return housing 81' can each include one or more resilient members 89*a*-89*n* (referred to collectively as "resilient members 89"). The number and length of the resilient members 89 can be determined by various characteristics including a desired travel distance (compressibility distance of the resilient members to move the swing arm 25 90 degrees), a desired length of the first and second spring return housings 81 and 82, and desired return force. As discussed herein, the number of spring housings and resilient members included can be selected such that the desired travel distance and return force is achieved while minimizing the length of the first and second spring return housings 81, 82

The first and second spring return housings 81, 81' can be identical. Reference to the first spring return housing 81 will be referenced for clarity. The first spring return housing 81 can include a first end 95 and a second end 96. The first end 95 include openings 97 which a chain 83 extends and is coupled to the one or more resilient members 89 within the spring return housing 81, which allows for the 90 degree rotation.

Figure 10:
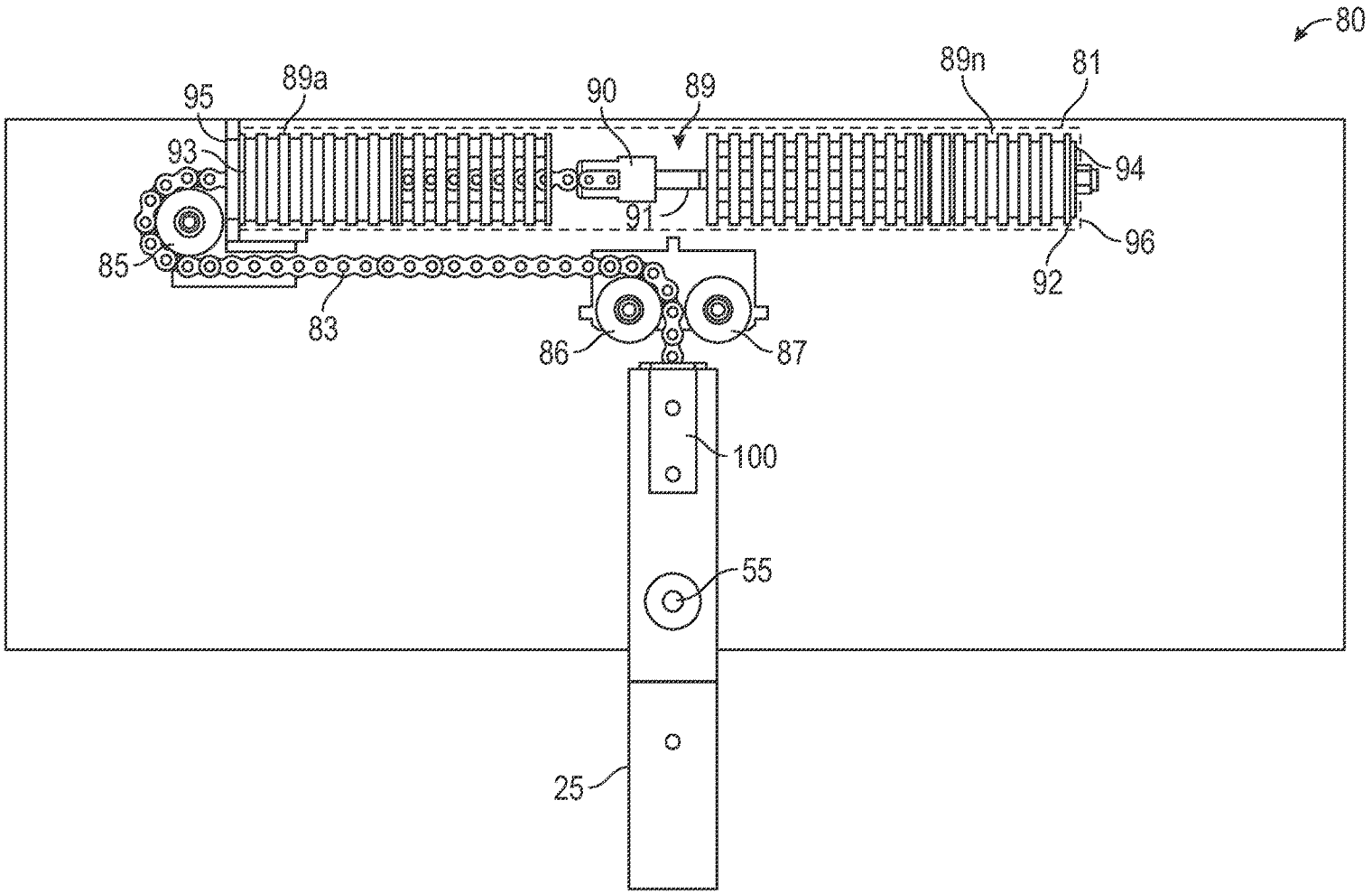
FIG. 10 is a top view of a portion of the gate release mechanism at the neutral position, according to some example embodiments.
Figure 11:
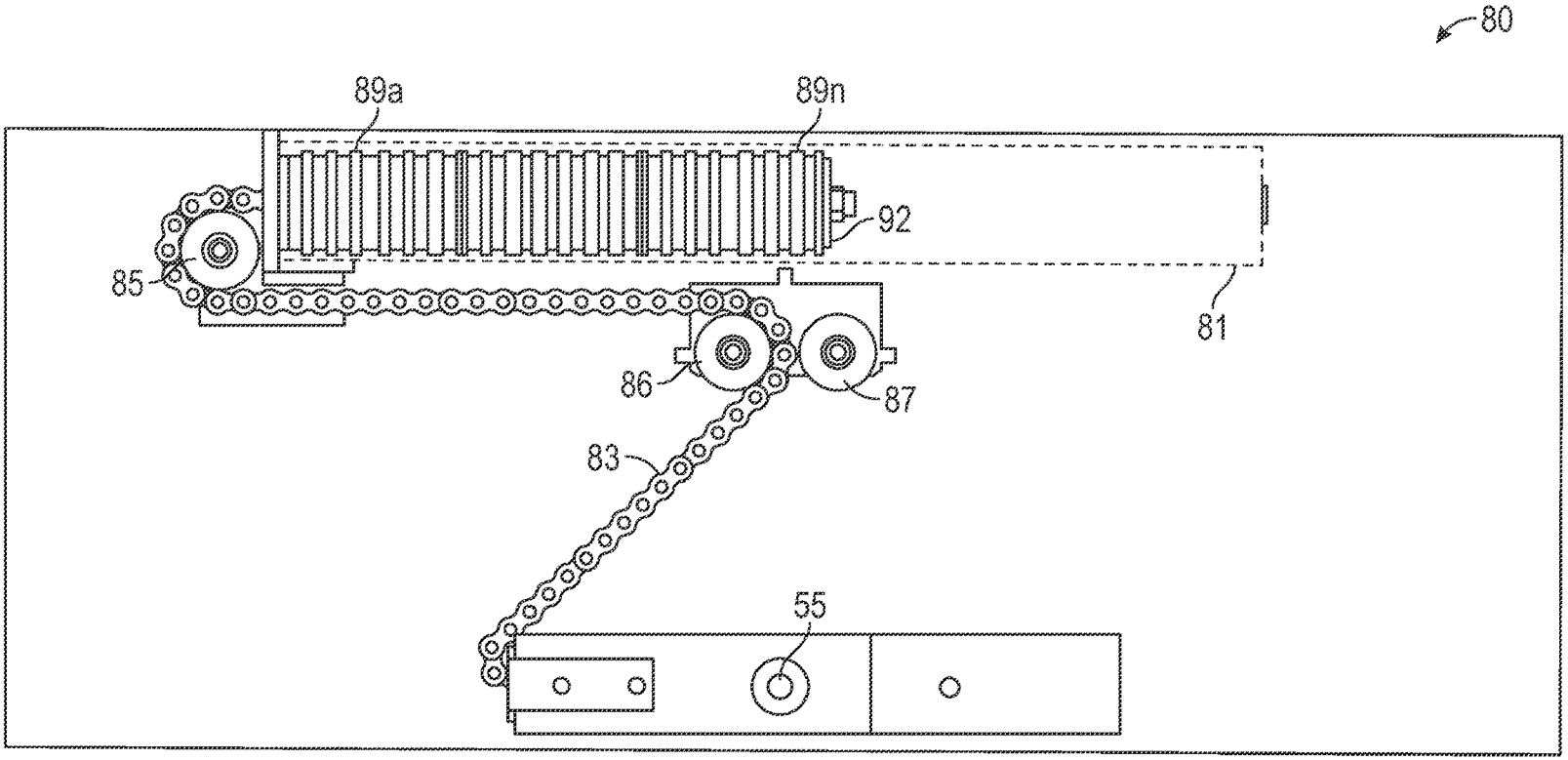
FIG. 11 is a top view of the portion of the gate release mechanism shown in FIG. 11, at a non-neutral position.
Figure 12:
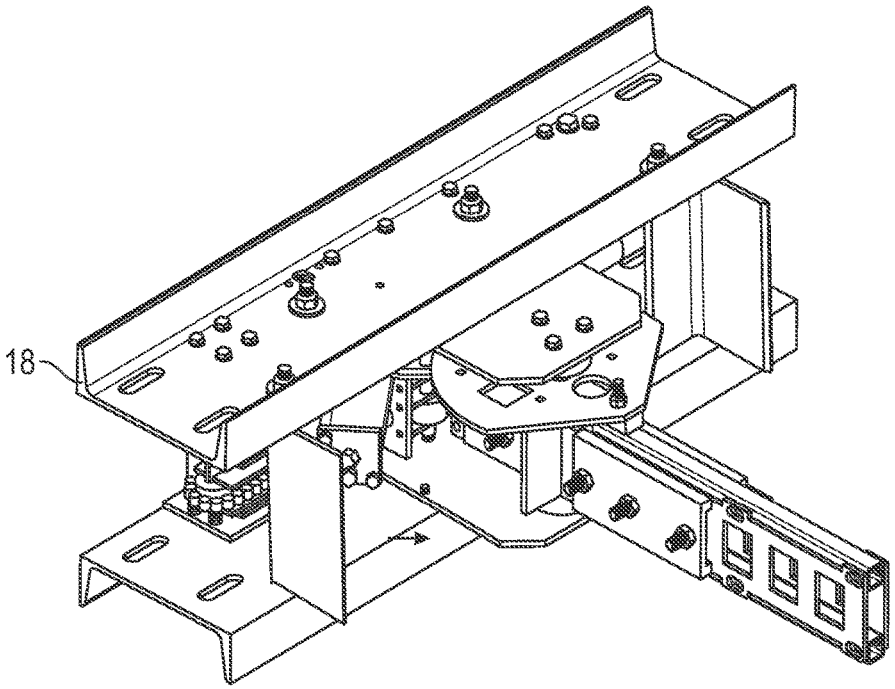
FIG. 12 is a perspective view of a gate release mechanism including a counter and a locking bolt, according to some example embodiments.
Figure 13:
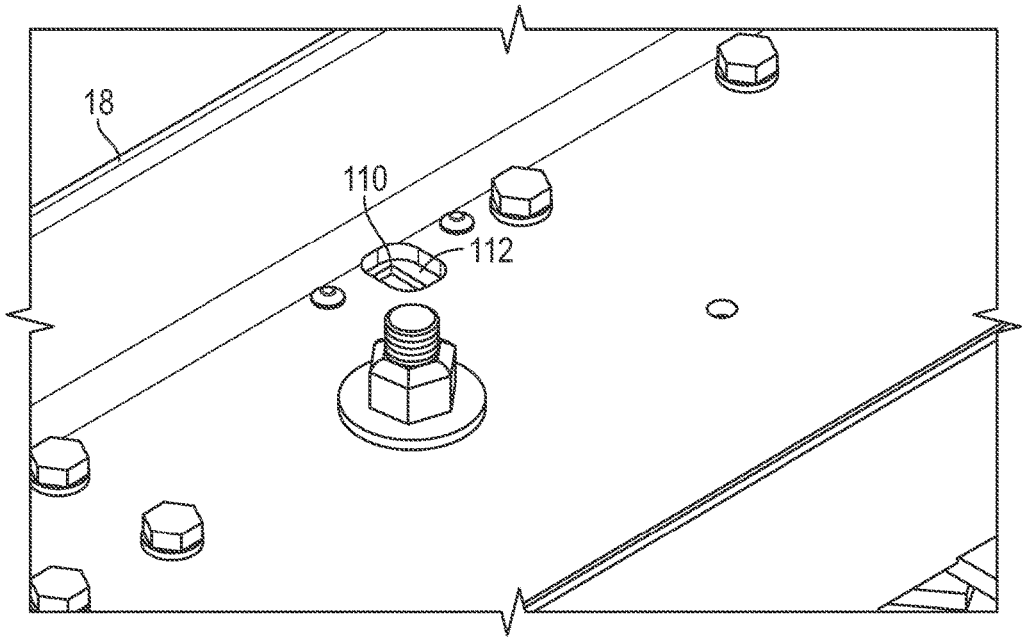
FIG. 13 is a close-up of a window of the counter, according to some example embodiments.
Figure 14:
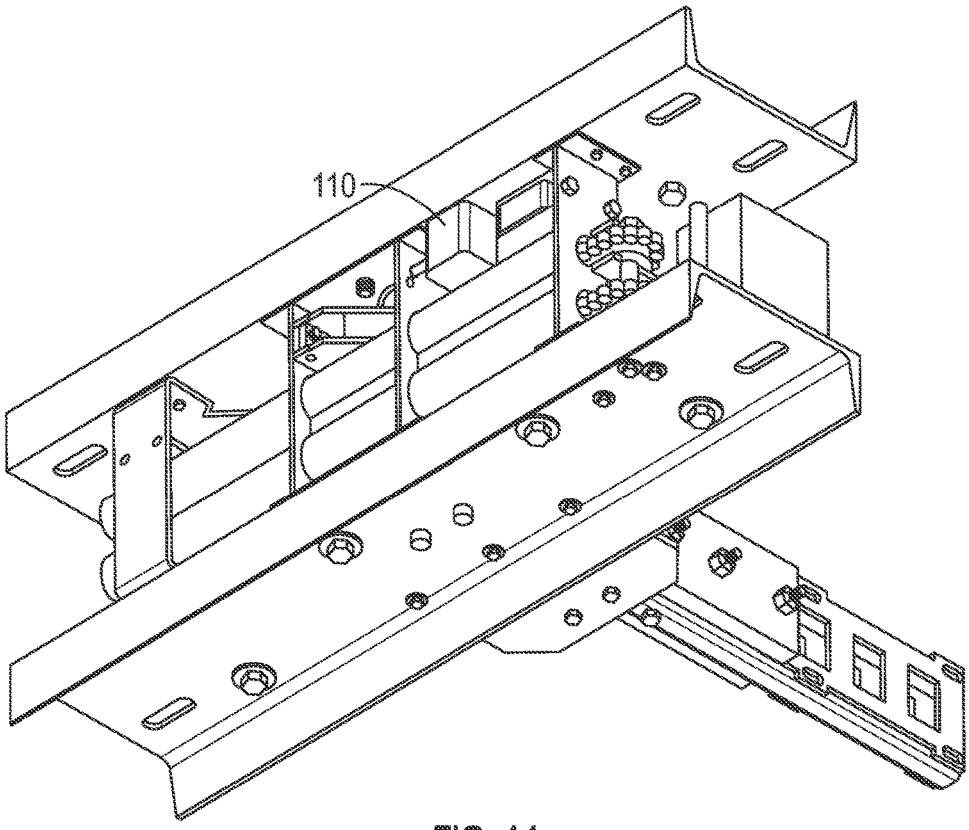
FIG. 14 is a perspective view of the gate release mechanism illustrating the location of the counter, according to some example embodiments.
Figure 15:
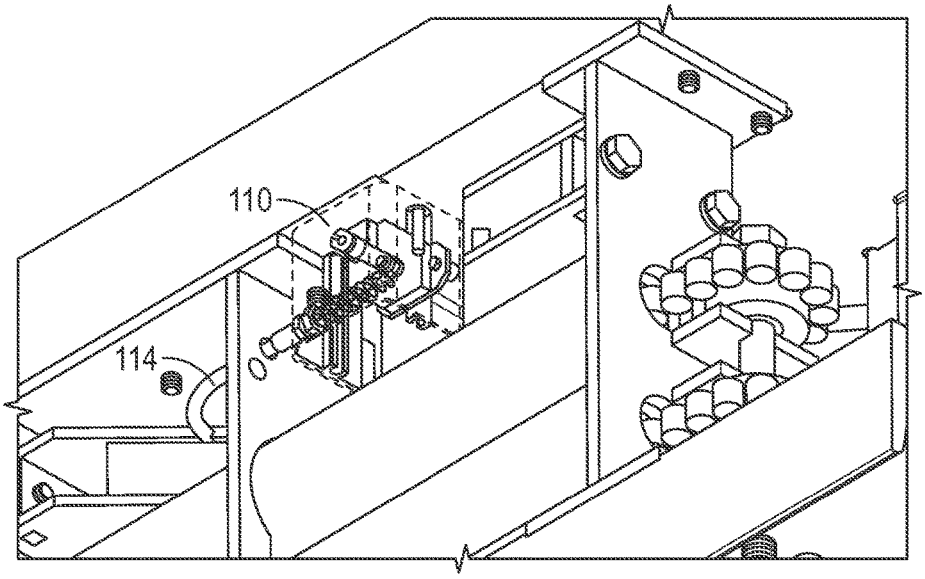
FIG. 15 is a perspective view of the gate release mechanism including the counter where the housing of the counter is transparent, according to some example embodiments.
Figure 16:
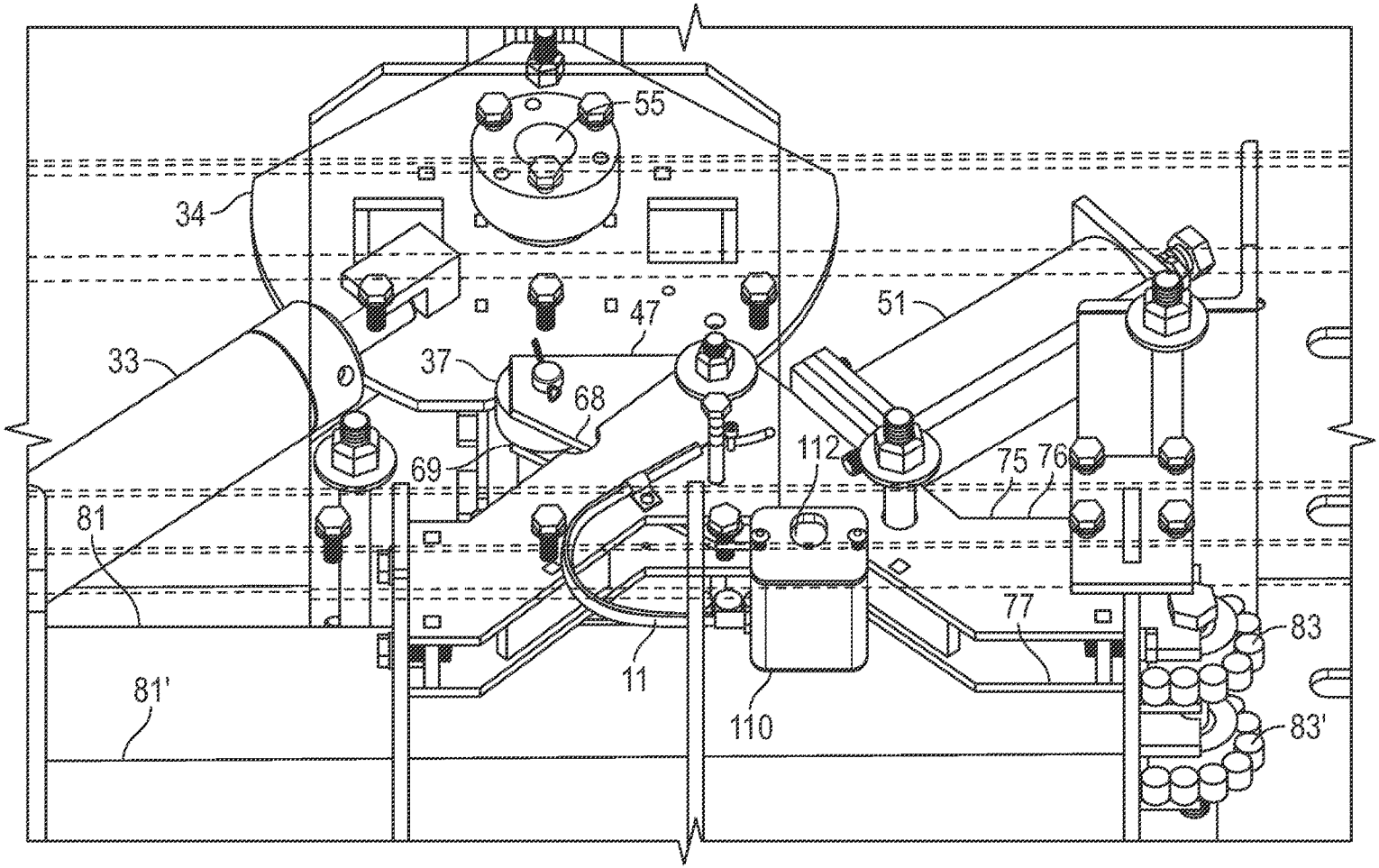
FIG. 16 is a perspective view of a portion of the gate release mechanism, according to some example embodiments.

As shown in FIG. 10, one of the resilient members 89 is removed to show the anchor 89. The anchor 89 includes a chain engagement end 90, an elongated shaft 91, and a compression washer 92. The resilient members 89 define a first end 93 and a second 94. The first end 93 is configured to abut an inside surface of the first end 95 of the spring return housing 81 and the second end 94 is configured to abut the compression washer 92 such that the compression washer 92 is between the second end 92 of the resilient member 89 and the second end of the spring return housing 81. The chain engagement end 90 and the elongated shaft 91 can extend through the resilient members 89 and the compression washer 92 is configured to abut a second end 93 of the resilient members 89. In FIG. 10, the swing arm 25 is in the neutral position and the compression washer 92 is abutting the second end 96 of the spring return housing 81. The resilient members 89 at the neutral position can be in a pre-compressed state. Any rotation of the swing arm 25 in either direction pulls the chains 83, 83' around rollers 85, 85' and between rollers 86, 86' and 87, 87', which pulls the anchor 88, 89' within the spring return housings 81, 82 to the left, as shown in FIG. 11, to compress the resilient member 89.

Having the chain 83 coupled to the swing arm 25 and the resilient members 89, the spring force is transmitted to swing arm 25 (and the gate coupled thereto). As the gate 14 (and swing arm 25) rotates, the resilient members 89 compress as the resilient members 89 is pulled toward the left side of the spring return housing 81. In on example, there are two chains 83, 83' and two return spring housings 81, 81'. The stack of resilient members 89, 89' are compressed to fit into the return spring housings 81, 81', thereby providing a return force near center that is high, the return force at full swing is only slightly higher, and the gate arm can swing a full 90 degrees in both directions.

The gate release mechanism 10 can include a shock absorber 33 that is coupled to the detent cam 34 and pivotally secured to a support bracket 35 (shown in FIG. 2). The shock absorber 33 when moved to a compressed position allows for the rapid rotational movement of the pivot arm assembly 30 from and beyond the neutral detent position during impingement of the crossing arm 14. The shock absorber 33 allows for a slower rate of movement when returning to the centered neutral position to suitably control the return rate of the pivot arm assembly 30 subsequent to impingement of the crossing arm 14.

Referring back to FIG. 2, mounting brackets 15 can be used to secure the gate 14 to the swing arm 25. Service pivot point 17 can be the pivot point when the mounting brackets 15 are removed and the gate return mechanism does not wish to be used, e.g., during servicing. When the mounting brackets 15 are removed, the gate 14 can still be coupled to the swing arm 25 but not to the detent cam 34 such that the gate 14 can be rotated about service pivot point 17 and not initiate the detent cam 34 to rotate.

FIGS. 12-16 illustrate a counter 110 that can be coupled to the mounting bracket 18. The mounting bracket 18 can include a window 112 that can display a number. The number is the number of times the gate release mechanism 10 has been activated. The counter can include a cable wire 114 that can be coupled to the detent frame 75 and detent lever 47 and increase the number every time the detent roller 37 moves from the neutral position.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Various Notes & Examples

Each of the following non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A gate release device, comprising:

a pivot arm assembly configured to be coupled to a gate to allow the gate to pivot away from an impact in a first direction and a second direction opposite the first direction, the pivot arm assembly, including:

a swing configured to be coupled to the gate;

a detent cam coupled to the swing, the detent cam including a first guide surface, a second guide surface, a semicircle detent positioned between the first and second guide surface, and a pivot point, wherein the gate is configured to rotate about the pivot point when the gate receives the impact in either the first or second direction;

a detent roller configured to be positioned within the semicircle detent when the gate is at a neutral position, wherein the detent roller moves along the first guide surface when the impact is in the first direction and the detent roller moves along the second guide surface when the impact is in the second direction;

a detent lever; and a detent plunger coupled to the detent lever and configured to apply a force to the detent roller.

2. The gate release device of claim 1, wherein the detent plunger includes:

a plunger housing having a first end plate and a second end plate;

a resilient member having a first end and a second end, the resilient member positioned within the plunger housing; and a plunger shaft having a first end and a second end, the plunger shaft moveable relative to the plunger housing, wherein the first end of the plunger shaft extends through the first end plate of the plunger housing and is coupled to the detent lever and the second end of the plunger shaft includes a shoulder positioned inside of the plunger housing and is configured to abut an inside surface of the first end plate and the first end of the resilient member.

3. The gate release device of claim 2, wherein to move the gate from the neutral position, when the detent roller is positioned within the semicircle detent, to a non-neutral position, when the detent roller is positioned along one of the first and second guide surfaces, an impact force of the impact is greater than a plunger force applied to the detent roller via the detent plunger.

4. The gate release device of claim 3, wherein the plunger force is adjustable.

5. The gate release device of claim 4, the detent plunger further includes:

an adjuster including an adjustment bolt extending through and threadably engaged with an aperture of the second end plate and an adjustment washer coupled to the adjustment bolt and positioned within the plunger housing configured to abut the second end of the resilient member.

6. The gate release device of claim 5, wherein plunger force applied by the resilient member is adjustable by rotating the adjustment bolt such that the adjustment washer changes the length of the resilient member within the plunger housing.

7. The gate release device of claim 2, wherein the detent lever includes a top detent lever plate and a bottom detent lever plate, and the detent roller and the plunger shaft are positioned between the top and bottom detent roller plates.

8. The gate release device of claim 3, wherein the detent lever is coupled to a detent lever frame at a detent lever pivot point, wherein the detent lever rotates about the detent lever pivot point when the swing moves in response to the impact.

9. The gate release device of claim 1, further including:

a spring return assembly configured to return the gate from rotation about the pivot point back to the neutral position, the spring return assembly including:

a first spring return housing having a first end and a second end;

at least one return resilient member positioned within the first spring return housing, the at least one return resilient member having a first end positioned adjacent the first end of the first spring return housing and a second end positioned adjacent the second end of the first spring return housing;

an anchor including a chain engagement end, an elongated shaft, and compression washer; and a chain including a first chain end coupled to the chain engagement end and a second chain end coupled to the swing, wherein the compression washer is configured to abut the second end of the at least one return resilient member.

10. The gate release device of claim 1, further including:

a shock absorber coupled to the detent cam to damp a return speed of the gate about the pivot point back to the neutral position.

11. The gate release device of claim 1, wherein the swing has a longitudinal axis, and wherein the swing is configured to rotate about the pivot point at least plus or minus 90 degrees of the longitudinal axis.

12. A gate release device, comprising:

a pivot arm assembly configured to be coupled to a gate to allow the gate to pivot away from an impact in a first direction and a second direction opposite the first direction, the pivot arm assembly, including:

a swing configured to be coupled to the gate;

a detent cam coupled to the swing, the detent cam including a first guide surface, a second guide surface, a semicircle detent positioned between the first and second guide surface, and a pivot point, wherein the gate is configured to rotate about the pivot point when the gate receives the impact in either the first or second direction;

a detent roller configured to be positioned within the semicircle detent when the gate is at a neutral position, wherein the detent roller moves along the first guide surface when the impact is in the first direction and the detent roller moves along the second guide surface when the impact is in the second direction; and a spring return assembly configured to return the gate from rotation about the pivot point back to the neutral position, the spring return assembly including:

a first spring return housing having a first end and a second end;

at least one return resilient member positioned within the first spring return housing, the at least one return resilient member having a first end positioned adjacent the first end of the first spring return housing and a second end positioned adjacent the second end of the first spring return housing;

an anchor including a chain engagement end, an elongated shaft, and compression washer; and a chain including a first chain end coupled to the chain engagement end and a second chain end coupled to the swing, wherein the compression washer is configured to abut the second end of the at least one return resilient member.

13. A gate release device, comprising:

a pivot arm assembly configured to be coupled to a gate to allow the gate to pivot away from an impact in a first direction and a second direction opposite the first direction, the pivot arm assembly, including:

a swing configured to be coupled to the gate;

a detent cam coupled to the swing, the detent cam including a first guide surface, a second guide surface, a semicircle detent positioned between the first and second guide surface, and a pivot point, wherein the gate is configured to rotate about the pivot point when the gate receives the impact in either the first or second direction;

a detent roller configured to be positioned within the semicircle detent when the gate is at a neutral position, wherein the detent roller moves along the first guide surface when the impact is in the first direction and the detent roller moves along the second guide surface when the impact is in the second direction;

a detent lever; and a detent plunger coupled to the detent lever and configured to apply a force to the detent roller, wherein to move the gate from the neutral position, when the detent roller is positioned within the semicircle detent, to a non-neutral position, when the detent roller is positioned along one of the first and second guide surfaces, an impact force of the impact is greater than a plunger force applied to the detent roller via the detent plunger.

* * * * *